US007996949B2

(12) United States Patent
Rosenzweig et al.

(10) Patent No.: US 7,996,949 B2
(45) Date of Patent: Aug. 16, 2011

(54) FABRIC TOWEL WITH SLIDER FOR STEAM APPLIANCE

(75) Inventors: Maximilian Rosenzweig, Montreal (CA); Ognjen Vrdoljak, Laval (CA)

(73) Assignee: Euro-Pro Operating LLC, Newton, MA (US)

( * ) Notice: Subject to any disclaimer, the term of this patent is extended or adjusted under 35 U.S.C. 154(b) by 0 days.

(21) Appl. No.: 12/612,415

(22) Filed: Nov. 4, 2009

(65) Prior Publication Data

US 2010/0107351 A1 May 6, 2010

Related U.S. Application Data

(60) Provisional application No. 61/111,445, filed on Nov. 5, 2008.

(51) Int. Cl.
*A47L 13/00* (2006.01)

(52) U.S. Cl. ..... 15/209.1; 15/228

(58) Field of Classification Search ..... 15/208, 15/209.1, 118, 119.1, 119.2, 120.1, 120.2, 15/121, 228, 223; 428/77, 192; 442/381, 442/389, 394, 400, 414, 149
See application file for complete search history.

(56) References Cited

U.S. PATENT DOCUMENTS

| | | | | |
|---|---|---|---|---|
| 3,761,991 | A | 10/1973 | Moss | |
| 5,725,927 | A | 3/1998 | Zilg et al. | |
| 7,033,965 | B2 * | 4/2006 | Takabayashi et al. | 442/381 |
| 7,386,907 | B2 * | 6/2008 | Otsuka et al. | 15/104.002 |
| 7,669,280 | B2 | 3/2010 | Rosenzweig | |
| 2005/0022843 | A1 | 2/2005 | Policicchio et al. | |
| 2006/0000049 | A1 * | 1/2006 | Rosenzweig | 15/322 |
| 2006/0000241 | A1 | 1/2006 | Rosenzweig | |
| 2007/0136973 | A1 | 6/2007 | Patel et al. | |
| 2009/0279938 | A1 | 11/2009 | Rosenzweig et al. | |

FOREIGN PATENT DOCUMENTS

| | | | |
|---|---|---|---|
| EP | 1 212 972 | A2 | 6/2002 |
| WO | WO 90/14039 | A1 | 11/1990 |

OTHER PUBLICATIONS

International Search Report and Written Opinion for PCT/US2009/063361 mailed Aug. 5, 2010.

* cited by examiner

*Primary Examiner* — Dung Van Nguyen
(74) *Attorney, Agent, or Firm* — Wolf, Greenfield & Sacks, P.C.

(57) ABSTRACT

A fabric towel with a slider pattern for use on a cleaning surface with at least one fastener to secure the towel to a steam frame. The fabric towel is used with a steam appliance and the slider pattern reduces friction when used on a fabric or carpeted surface yet provides a sufficient amount of towel surface to steam. In one embodiment, the fabric towel is a steam pocket including a top and bottom layer joined around its perimeter with an open side to allow for mounting on a steam frame with fasteners secured to each layer and wrapped around the back of a steam frame. The slider pattern may be a single piece or a plurality of segments secured to the towel. In another embodiment, towel is a steam pad with has at least one fastener for attachment to the steam cleaner frame.

17 Claims, 8 Drawing Sheets

FABRIC TOWEL WITH SLIDER FOR STEAM APPLIANCE

CROSS-REFERENCE TO RELATED APPLICATION

This application is based on and claims the benefit of U.S. provisional application No. 61/111/445 filed on Nov. 5, 2008, the contents of which are incorporated herein by reference.

BACKGROUND OF THE INVENTION

The invention relates generally to a fabric towel for a steam appliance, and more particularly to a towel pad or pocket having slider regions to reduce friction between the towel and fabric being cleaned for use with a steam cleaner.

Steam cleaners and/or devices used to apply steam to household objects are well known. The uses of the devices vary widely, and may include the application of steam to drapes or other fabrics to ease wrinkles, and the application of steam to objects to assist in cleaning the objects. Steam cleaners also have been used for cleaning carpeted floors, but usually overly saturate the carpet and require long period of time to dry.

Typical steam devices have a reservoir for storing water that is connected to an electrical water pump with an on/off switch. The exit from the electric water pump is connected to a steam boiler with a heating element to heat the water. The heated water generates steam, which may be directed towards its intended destination through a nozzle which controls the application of the steam. Variation of the shape and size of the nozzle allows for preferred distribution of generated steam to an object to be cleaned. The nozzles may be disconnectable from the steam generator to allow different nozzles to be utilized, based on the object to be steamed. The nozzle may be either closely coupled to the steam generator, or located at a distance from the steam generator, requiring tubing or other steam transfer structures to be interconnected between the steam generator and the discharge nozzle. Typically, it is beneficial to provide suitable connectors between the steam generator and the nozzle to allow either the nozzle to be connected to the steam generator, or to allow the interpositioning of transfer tubes or hoses between the steam generator and the nozzle.

In general, the nozzles used with the steam cleaners do not have large surface areas. A cloth or towel is placed on a steam frame coupled to the steam nozzle to distribute the steam.

Notwithstanding the wide variety of steam generating appliances and cleaning towels available, there exists the need to provide steam towel that is easy to use with a steam cleaner for cleaning fabrics and carpets.

SUMMARY OF THE INVENTION

Generally speaking, in accordance with the invention, a towel in the form of a pocket or a pad for mounting on a steam frame of a steam generating device is provided. The steam towel is at least one layer of a substantially planar fabric having an upper surface and a bottom surface. At least the bottom surface includes a flexible slider pattern selected to reduce the friction between the towel and a fabric or carpet being steamed, yet leaves sufficient amount of towel surface exposed to steam the fabric or carpet surface. The slider material may cover from about 10 to 50 percent of the surface area of the towel surface. The fabric towel includes at least one fastener to secure the towel to a steam appliance frame.

The steam towel may be in the form of a steam pocket and include a top and a bottom layer that is joined around its perimeter to provide an open side for mounting on a steam frame. A pair of straps secured to the one layer along an open edge is wrapped around the back of the frame and be secured to the second layer of fabric. In another embodiment, the steam towel may be a fabric pad with a slider pattern on one surface and fasteners on the other surface to engage the frame.

The slider pattern is formed of a flexible polymeric material such as poly ethylene and is placed on the towel surface by stitching or bonding. The pattern may be a single piece or a series of sections. Thin regions are formed on the pattern to enable the towel to be flexible and washed for reuse.

Accordingly, it is an object of the invention to provide a towel with slider regions for ease of use with a steam frame for cleaning fabrics and carpets.

Another object of the invention is to provide a steam towel with slider pattern on opposed layers of towel for two sided cleaning.

A further object of the invention is to provide a steam towel with a plastic slider pattern having thin areas to allow the towel to be flexible.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is made to the following description taken in connection with the accompanying drawing(s), in which.

DETAILED DESCRIPTION OF THE INVENTION

Figure 1:
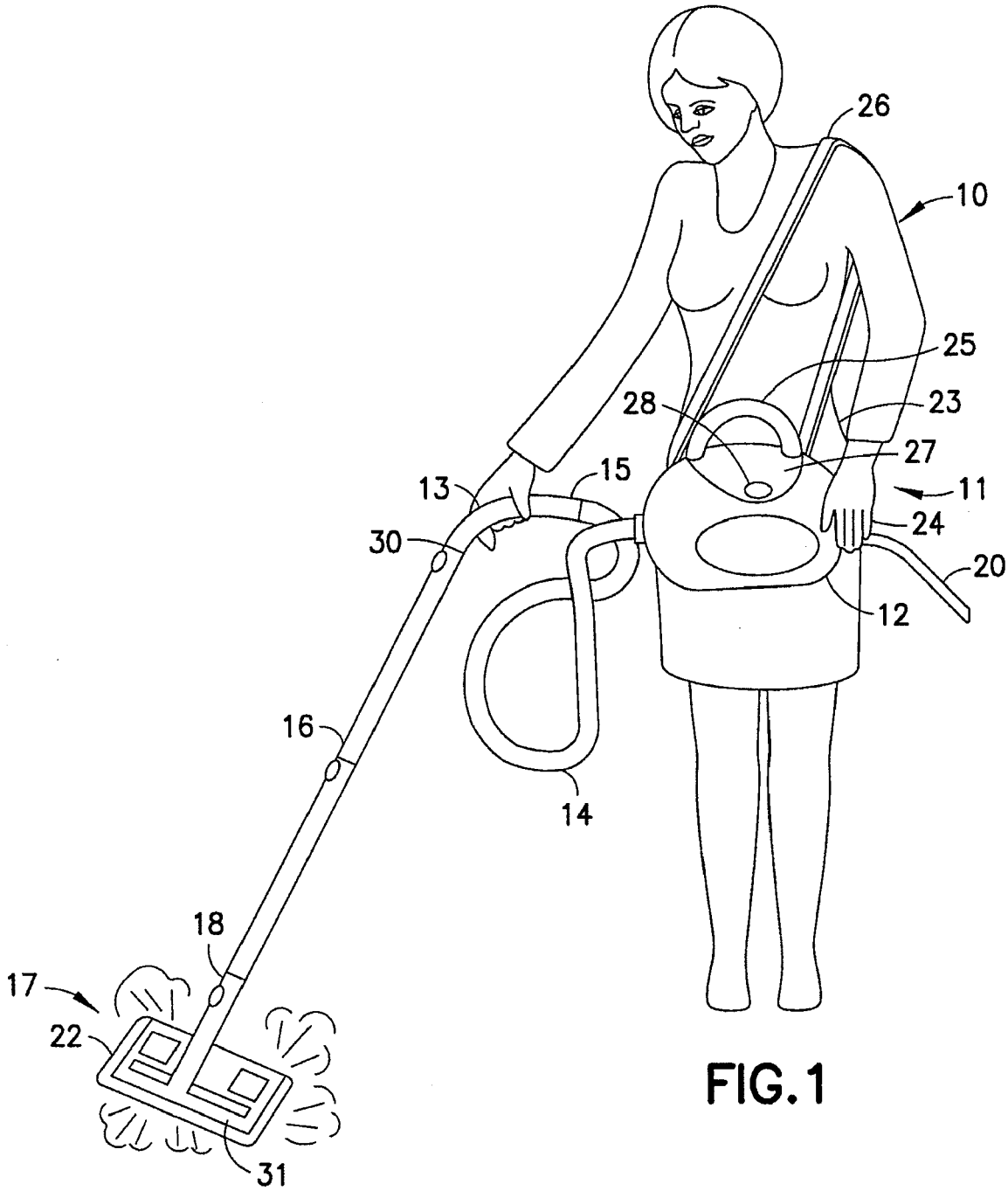
FIG. 1 is a perspective view of a user cleaning a carpeted floor with a portable steam cleaning device including a steam cleaner frame with a fabric towel constructed and arranged in accordance with the invention.

FIG. 1 is a perspective view of a user 10 using a steam cleaner 11 including a main body 12 and a steam release hand grip 13 coupled to main body 12 by a flexible hose 14 and a steam outlet 15. A rigid pipe 16 is mounted on the distal nozzle end of hand grip 13. A steam nozzle attachment 17 is mounted on the distal end of rigid pipe 16. Steam nozzle attachment 17 with a rectangular steam frame 31 and includes a pivotable hole steam inlet coupling 18 at the back edge or proximal end. Steam generated in housing 12 is dispensed into steam nozzle attachment 17 and to a towel 22 which covers the cleaning surface of steam frame 31.

Steam inlet 18 has the same configuration as steam outlet of to rigid pipe 16. This allows for installation of the different attachments to steam release hand grip 13 of steam cleaner 11, such as brushes and nozzles.

Main body 12 of steam cleaner 11 includes a water inlet 23 and an internal water reservoir 24 with heating elements connected to a power source by a power cord 20. Steam generated in reservoir 24 exits by steam outlet 15 through flexible hose 14 coupled thereto. Main body 12 is outfitted with a handle 25 and a strap 26 to allow user 10 to lift and carry main body 12. Conveniently, main body 12 also includes an on/off switch 27 and an indicator light 28 to indicate when steam temperature is appropriate for use.

Once water has been heated sufficiently to generate steam within main body 12, user 10 may selectively release steam by operation of hand grip 13. Hand grip 13 has a distal outlet end 30 for securing rigid pipe, or additional attachments, such as brushes or nozzles.

Figure 2:
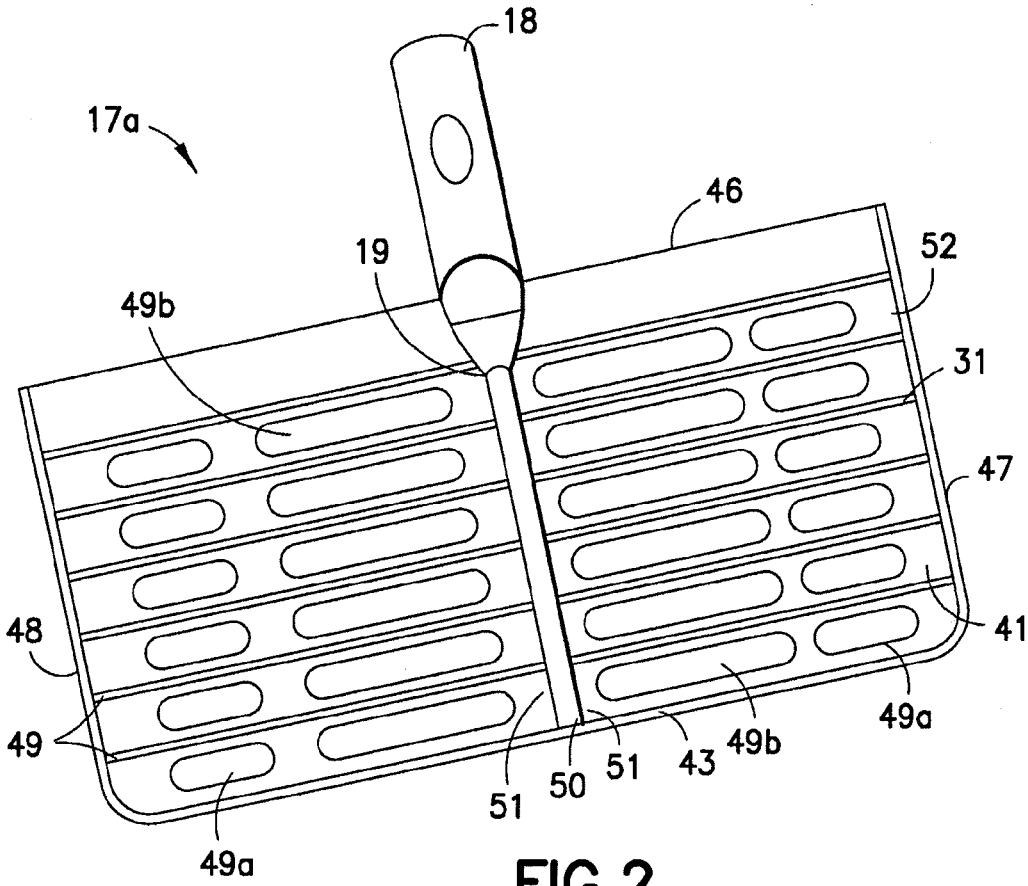
FIG. 2 is a top plan view of a steam frame that may be used with a steam cleaner shown in FIG. 1.

FIG. 2 is a top plan view of a steam nozzle attachment 17*a* for use with a steam cleaner. Here, a rectangular frame 31*a* includes a front wall 43, a rear wall 46, a right side wall 47 and a left side wall 48 with an upper surface 41 and a lower surface 42 (not shown). A plurality of baffles 49 extends from left side wall 48 to steam outlet 19 and from right side wall 47 to steam outlet 19 within frame 31. Baffles 49 are substantially planar with openings 49*a* and 49*b*. Frame 31 has rear wall 46 with steam inlet 18 connected thereto. Baffles 49 on both upper surface 41 and lower surface 42 are separated from each other by a rectangular plane 52 that connects front wall 43, rear wall 46, right side wall 47 and left side wall 48 of frame 31 together. In other words, rectangular plane 52 extends between the four walls and baffles 49 extends from the rectangular or central plane 52 to the top and bottom of the walls.

Steam outlet 19 has a passageway 50 that extends to front wall 43 perpendicular to baffles 49. Passageway 50 has a plurality of vents 51 on both upper surface 41 and lower surface 42 that surrounds passageway 50. Vents 51 between each baffle help direct steam into baffles 49. In this embodiment, there are channels between baffles 49 so that baffles 49*a* on the upper surface 41 and baffles 49*b* on the lower surface of frame 31 are connected. More details on this steam nozzle attachment may be found in a related U.S. application Ser. No. 11/083,421 entitled "Steam Nozzle Attachment For Use With Steam Cleaner," which is incorporated herein by reference in its entirety.

Figure 3:
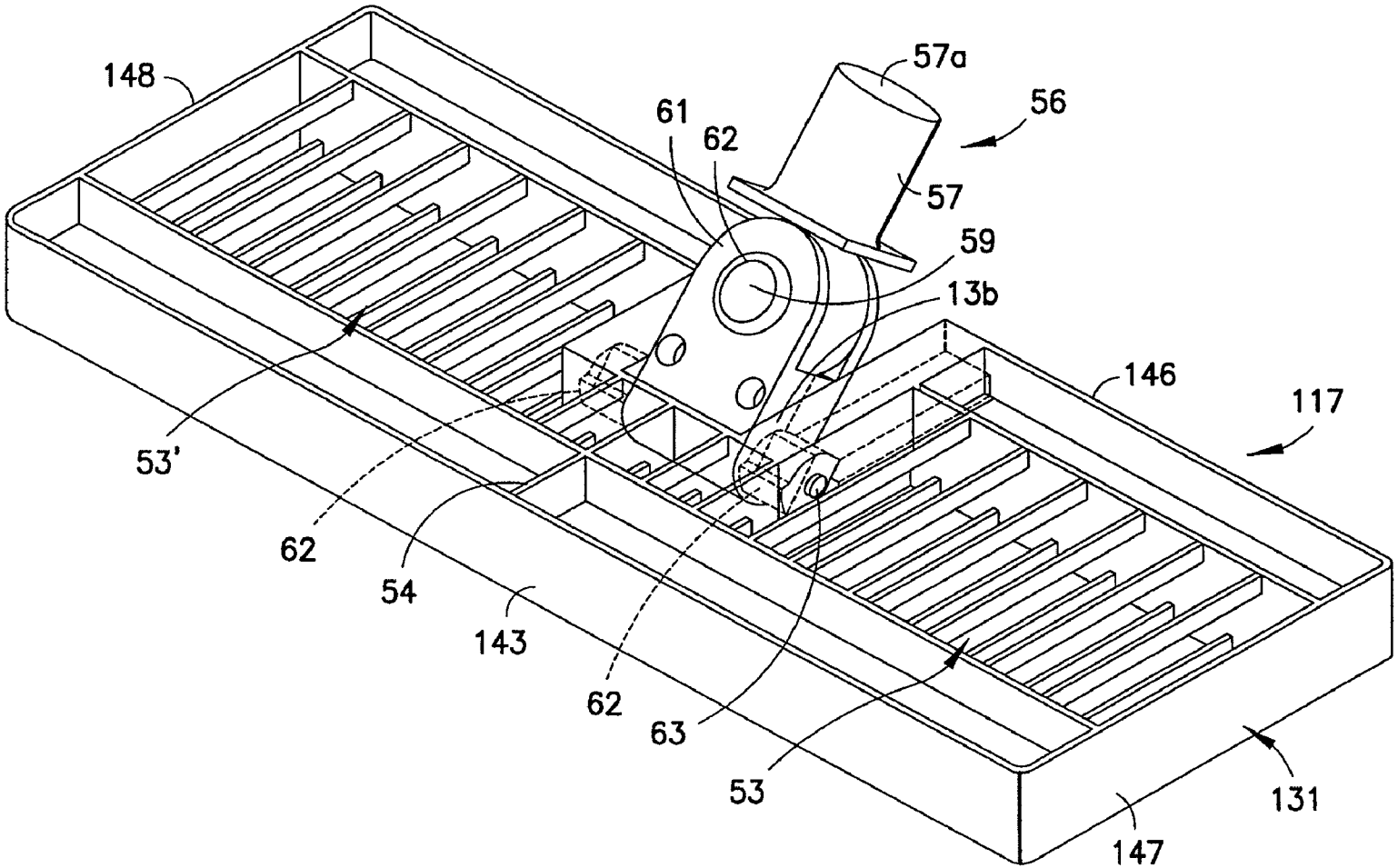
FIG. 3 is a perspective view of another steam frame that may be used with a steam cleaner shown in FIG. 1.

FIG. 3 is a top plan view of a steam nozzle attachment 117 for use with a steam cleaner. Identical elements in FIG. 2 that are present are identified by the same reference numerals plus 100. Note that there is no rectangular plane in this steam nozzle attachment 117. Here, a rectangular frame 131 includes two steam chambers 53 and 53' with a plurality of baffles 149 that are separated by partition 54. Frame 131 includes a front wall 143, a rear wall 146, a right side wall 147 and a left side wall 148. Here, instead of having steam inlet coupling 18 of FIG. 2, FIG. 3 has a universal connector 56 that is mounted on the distal end of the rigid pipe 16. Universal connector 56 includes upper connector piece 57 having a steam cleaner housing or pump end 57*a* that connects to either the distal end of the rigid pipe 16 or main body 12 and a pair of inner pivot plates 58 (not shown) with pivot buttons 59 at the other end 57*b* for pivotal connection to a distributor 61. Distributor 61 includes a hollow nipple portion which is not shown that connects to upper connector piece 57, two distributor plates 61 with holes 62 for aligning with pivot buttons 59 and a pair of arms 63 for engaging to frame 131 with a fluid opening 64.

Figure 4:
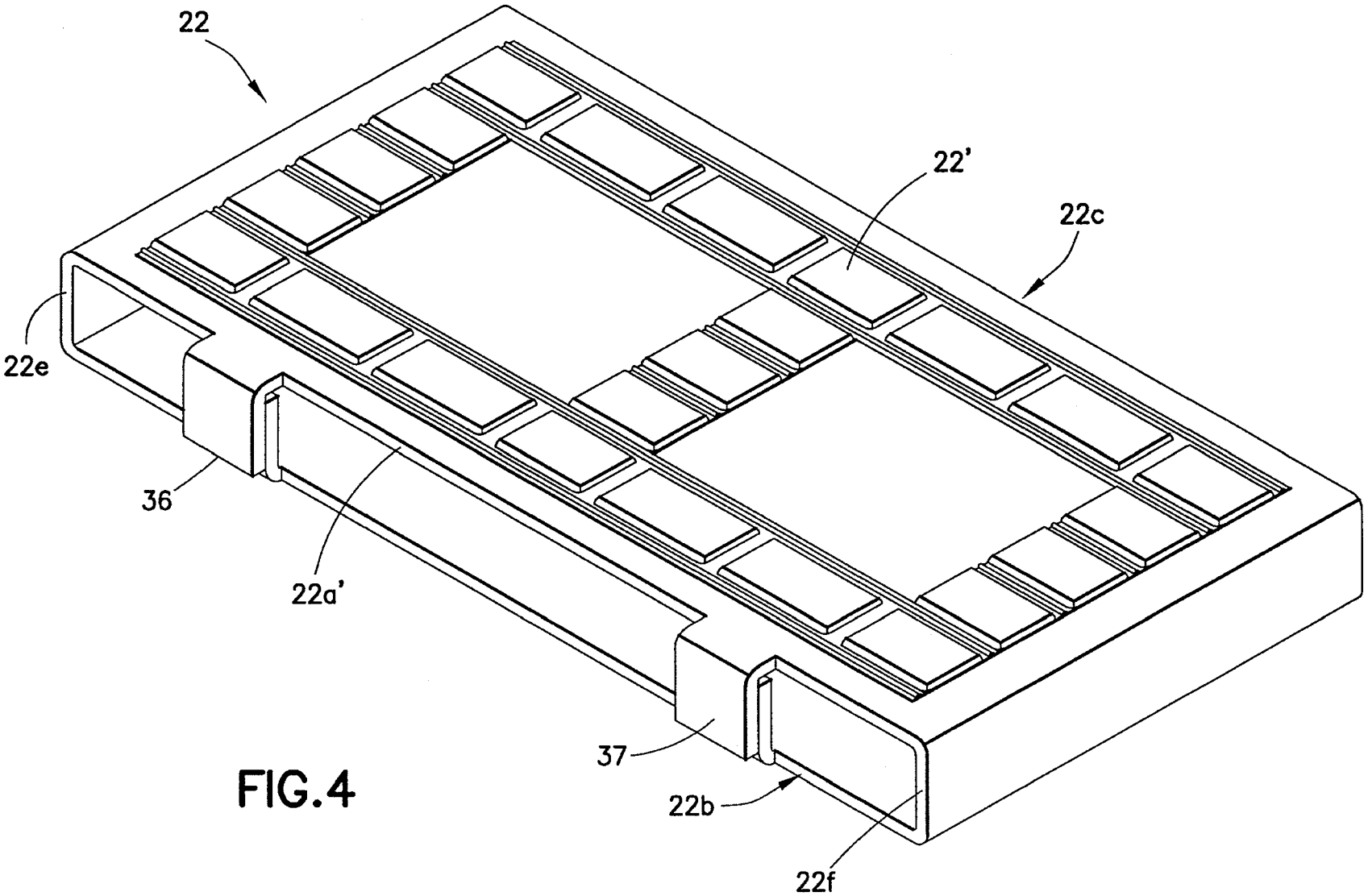
FIG. 4 is a perspective view of a towel with slider pattern constructed and arranged in accordance with one embodiment of the invention.

FIG. 4 shows a steam towel in the form of the steam pocket 22 with slider pattern 22' for use with steam frame 31 and 131. Steam pocket 22 is a cloth or fabric. It may be formed of any suitable fabric such as cotton or a synthetic fabric, such as polyester, acrylic, polyamide, or polyolefin fiber. Preferably, the fabric is a microfiber, such as a synthetic polyester microfiber. Steam pocket 22 includes a slider pattern 33 on its planar cleaning surfaces 22*a* and 22*a'* to facilitate movement of the steam pocket 22 on upholstery or carpeted floors. Preferably, slider pattern is made of plastic, such as polyester, such as polyethylene or nylon, acetyl, polypropylene, or any other polymeric material that can sustain high temperature caused by the steam.

Steam pocket 22 in FIG. 4 is configured to slip over a substantially rectangular steam frame 31 and 131. A top fabric layer 22*a* shown in FIG. 5 and an opposed bottom fabric layer 22*b*, each having a rectangular shape with two opposed long edges 22*c* and 22*d* and two opposed short sides 22*e* and 22*f* as shown in FIG. 4. In one embodiment, short edges 22*e* and 22*f* and one long side 22*c* are stitched to form the fabric surfaces into steam pocket 22.

A pair of straps 36 and 37 is mounted on an open side of steam pocket 22. In the preferred embodiment, fasteners 36 and 37 are Velcro-type fasteners. Alternatively, straps 36 and 37 may include buttons or snaps. In each case, straps 36 and 37 are placed over base 32 and secured to hold pocket 22 in place when used to clean a carpeted surface.

FIG. 4 shows a perspective view of steam pocket 22 having a plurality of slider strips 33 to form a slider pattern. Here, slider strips 33 are sewn onto fabric material of steam pocket 22 by stitches 29. Slider strips 33 may be attached to steam pocket 22 in numerous ways, such as being bonded, glued or riveted. Slider strips 33 are preferably at least as thick as the fabric of the steam pocket 22, but need to be thin enough to be flexible when moved across carpeted surfaces. The different thickness of the carpet to be cleaned also determines the different thickness of the slider material.

Figure 5:
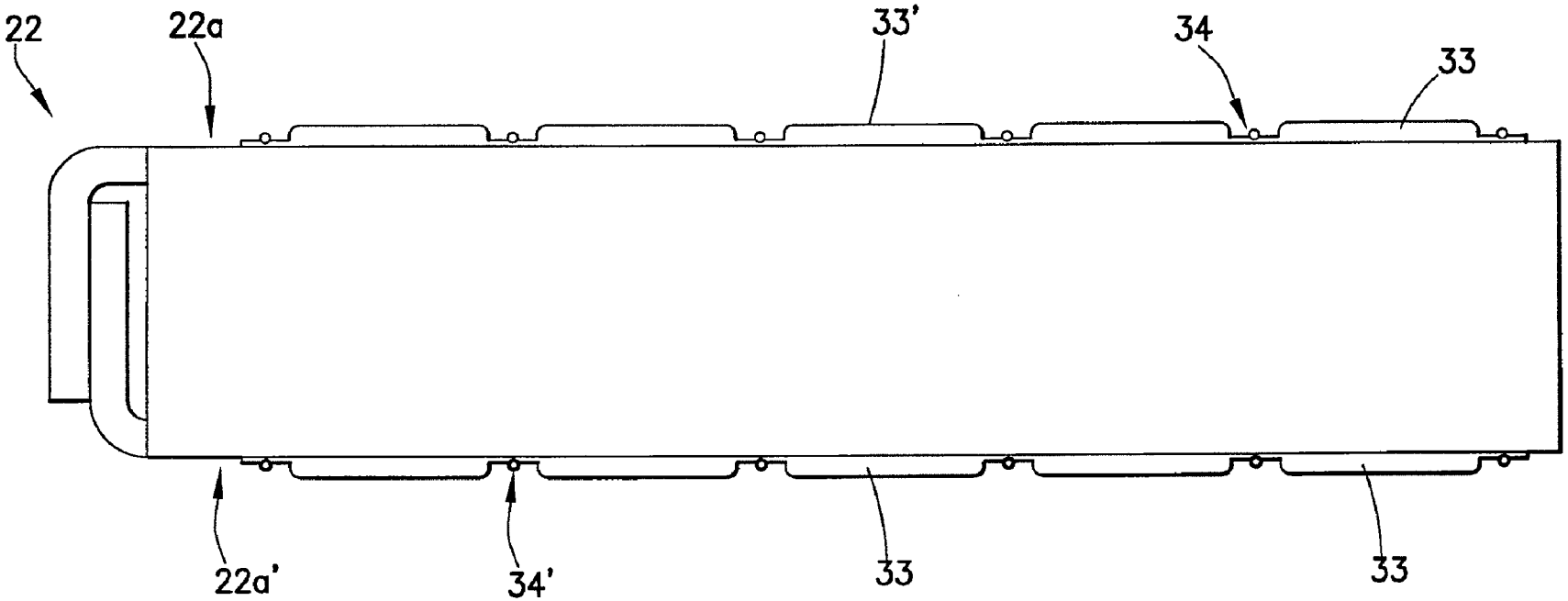
FIG. 5 is a cross-sectional view of the towel with slider patterns on the top and bottom layer in accordance with the invention.

FIG. 5 shows a side view of steam pocket 22 that has a plurality of slider strips 33 on both top layer 22*a* and bottom layer 22*a'*. Here, the edges of slider strips 33 are curved to improve the slidability of steam pocket 22 on fabric or carpeted surfaces. Slider strips 33 may be made in any shape and material that will reduce the friction against a fabric or carpeted surface, but still leaves sufficient amount of fabric surface exposed to contact with the fabric or carpet effectively to clean the carpeted surface. Here, slider strips 33 are made of one piece of plastic having a plurality of raised portion 33'. In between each raised portions 33' of slider there is a thin plastic region 34 to connect between each raised portion 33' section of slider strips 33. These thin plastic regions 34 are used to provide flexibility to the slider strips 33. In another embodiment, slider strips 33 may be made from multiple segments that are positioned on steam pocket 22 to create the friction reducing feature, but still leave enough fabric surface to clean the fabric or carpeted surface. A notch or opening (not shown) is made in steam pocket 22 between straps 36 and 37 of steam pocket 22 to accommodate for a connector 56. More details on this notch and connector may be found in a related U.S. application Ser. No. 12/118,015 entitled "Universal Connector For A Fluid Mop," which is incorporated herein by reference in its entirety.

Figure 6:
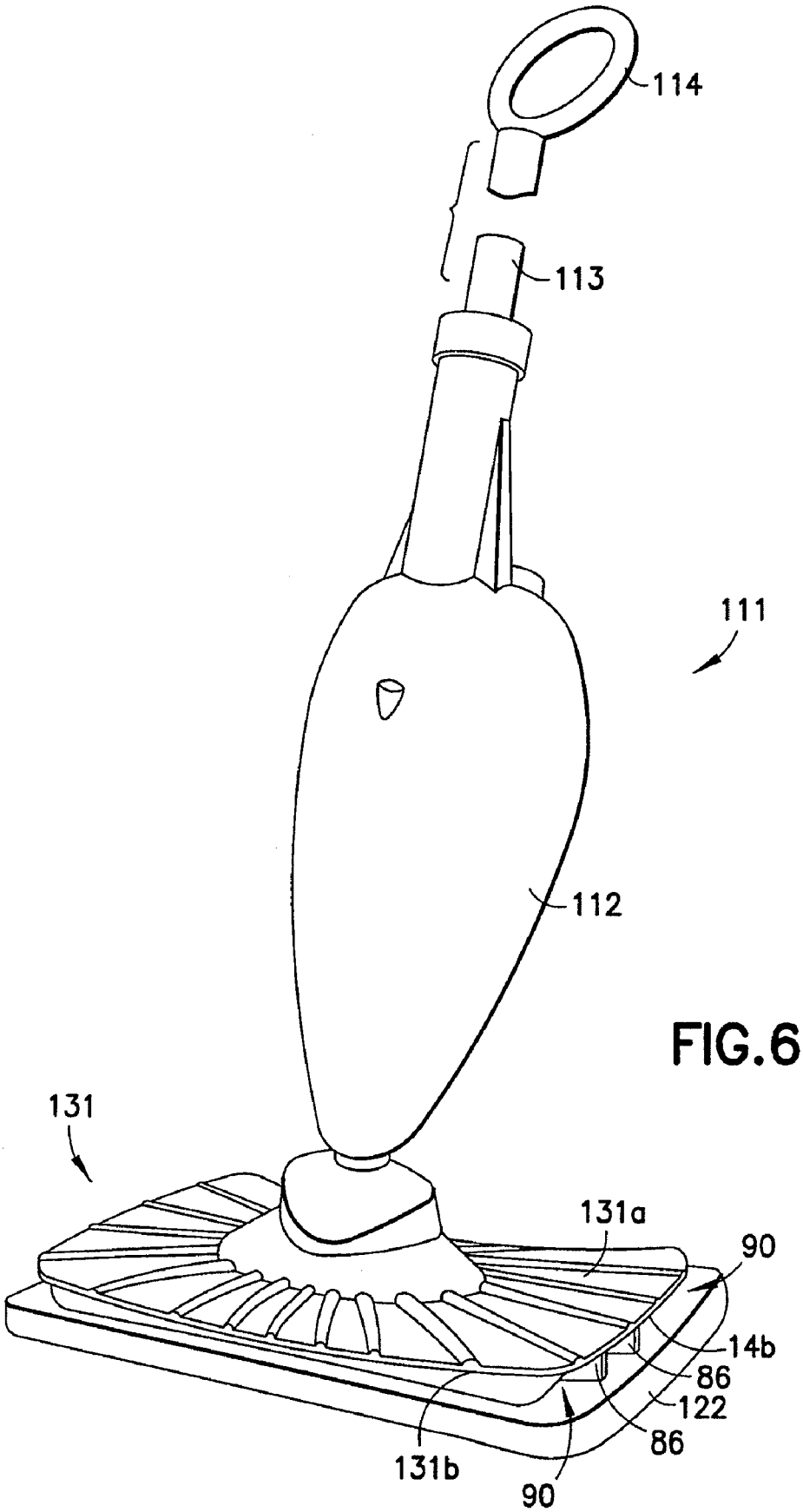
FIG. 6 is a perspective view of a steam cleaning device with a towel pad attached to a steam frame in accordance with the invention.

FIG. 6 shows a steam appliance 111 with a towel 122 mounted thereon constructed and arranged in accordance with another embodiment of the invention. Steam appliance 111 includes a housing or main body 112 connected to a steam frame 131 at one end and having a pole 113 connected to a handle 114 at the opposite end. Steam frame 131 has an upper surface 131*a* and an opposed bottom cleaning surface 131*b* also shown in FIG. 10. A steam pad 122 is secured to bottom cleaning surface 131*b*. Pad 122 has a fabric cleaning section 118 with a bottom cleaning surface 118*a* that include a slider pattern 133 as shown in FIG. 7 and an upper fastening surface 118*b* as shown in FIG. 7.

Figure 8:
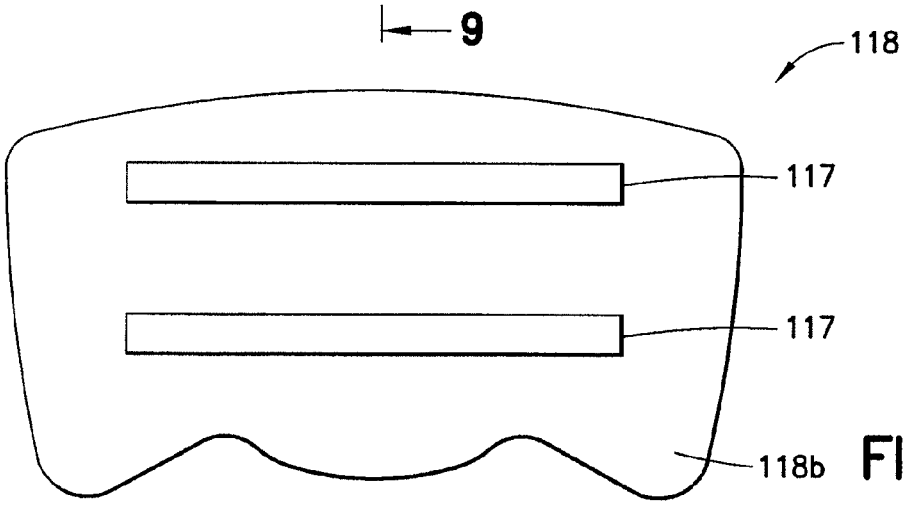
FIG. 8 is a plan view of the upper surface of the towel pad of FIG. 6 showing hook-and-loop fastening bands.

In FIG. 8, fastening surface 118*b* has a pair of hook and loop fastening bands 117 mounted thereon. Fastener bands 117 are secured to the fabric layers of towel 122 by stitching along the edges thereof through the fabric layers. Fastener bands 117 impart structural stiffness to the fabric layers as described below. Pad 122 is attached to steam frame bottom surface 131*b* by fastener bands 117 as described below in connection with FIG. 10. Alternatively, bands 117 may be attached by gluing, bonding or fusing to surface 118*b*.

Figure 7:
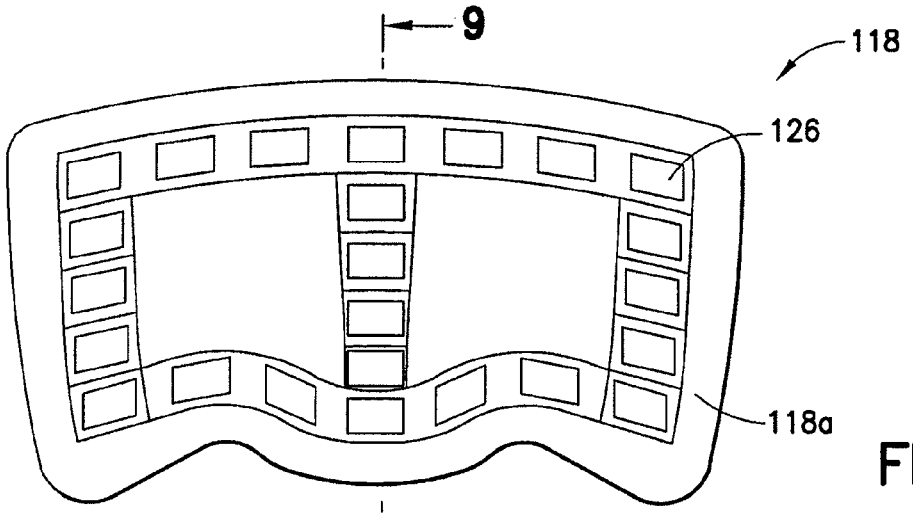
FIG. 7 is a plan view of the outside cleaning surface of the towel pad with slider patterns of FIG. 6.
Figure 9:
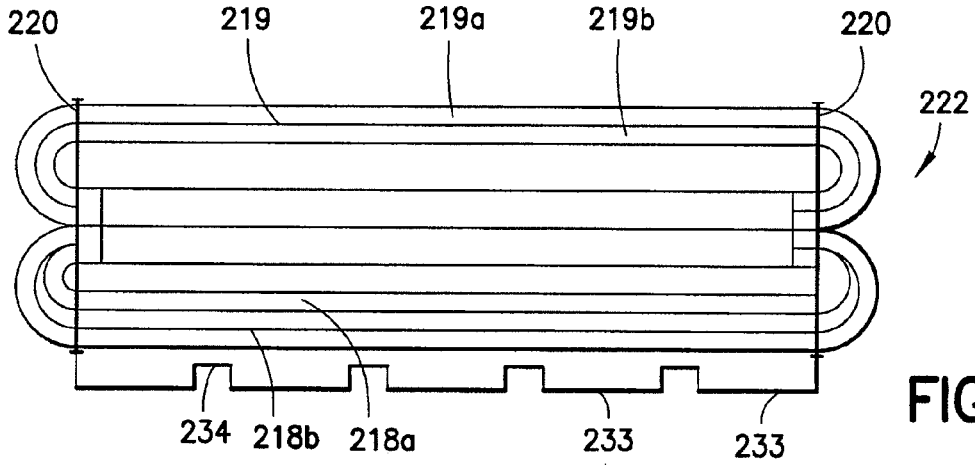
FIG. 9 is a cross-sectional view of the towel pad across line 9-9 of FIG. 7.

FIG. 9 shows a cross sectional view of pad 222 taken along line 9-9 of FIG. 7 that also includes an optional mesh layer 219. Here, pad 222 has bottom cleaning surface 218*a* and corresponding top fabric layer 218*b* with optional mesh layer 219 disposed on the outer surface of top fabric layer 218*b*. Here, fasten bands 217 are fastened on top of optional mesh layer 219. Top fabric layer 218*b* is placed against bottom fabric layer 218*a* and both layers are turned and mesh layer 219 is turned and then all layers are stitched along this periphery at a hemline 220. Fastener bands 217 are stitched through the three layers of fabric. Fastener bands 217 alternatively may be glued or fused to mesh layer 219. Here, fastener bands 217 are ribbons of Velcro receiving fasteners with hooks. This provides stiffness to towel pad 222. In this embodiment, pad 222 is substantially rectangular; however, it may be any convenient geometric shape, such as a triangle or circle.

Pad 222 has a plurality of sliders 233 on bottom cleaning surface 218*a* and hook and loop fastening bands 217 on upper surface 218*b*.

Fabric layers 218*a* and 218*b* are velour fabrics and may be the same construction or different. Mesh layer 219 can be a warp knit fabric having an exterior layer, fishnet construction 219*a* and an interior more tightly knit layer 219*b* fused together. Fastener bands 217 are disposed on fishnet surface 219*a* and attached to pad 222 by stitches.

In the illustrated embodiment, pad 222 is a cloth or towel. It may be formed of any suitable fabric such as cotton or a synthetic fabric, such as polyester, acrylic, polyamide or polyolefin fiber. Generally, pad 222 is formed from two layers of microfiber polyester fabric or blend and one mesh layer stitched about the perimeter.

In a preferred embodiment of the invention, bottom fabric layer 218*b* and top fabric layer 218*a* are a velour microfiber material. Mesh layer 219 is a two-layer warp knit fused together with exposed layer 219*a* having a fish net appearance and inner 219*b* layer a tighter knit. All the layers are turned and joined about the perimeter by a seam 220. Fastener bands 217 are disposed on mesh layer 219*a* and stitched through the three layers of pad 222 by a seam. Preferably, the fabric of pad 222 is a microfiber. Most preferably, the microfiber is a synthetic polyester or polyester and polyamide blend microfiber. This towel is substantially rectangular; however, it may be any convenient geometric shape, such as a triangle or circle. Bottom fabric layer 218*b* and second fabric layer 218*a* formed of a microfiber, such as a polyester microfiber have two velour surfaces. Bottom fabric layer 218*b* also include a plurality of sliders 233 that are made of plastic. Fasteners 217 are a Velcro-type fastener.

Figure 10:
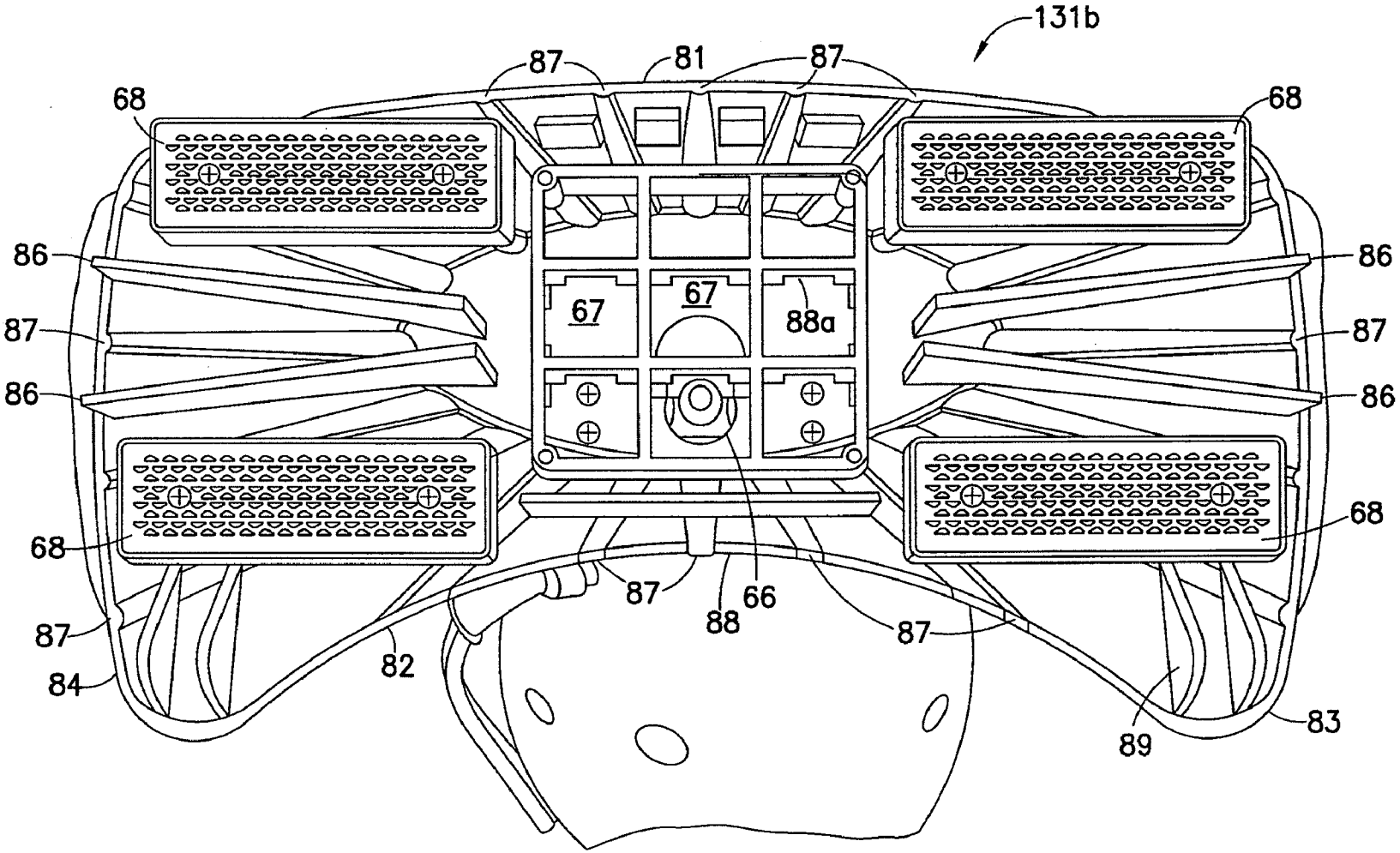
FIG. 10 is a plan view of the steam frame of the steam cleaner in FIG. 6.

A plan view of the bottom cleaning surface 131*b* of steam frame 131 of steam appliance 111 is shown in FIG. 10. Steam frame 131 is substantially rectangular in shape and includes a central steam opening 66 and cavity 67. Steam generated in steam boiler 21 dispenses steam into frame 131 through central steam opening 66 of frame 131 into cavity 67. Here, bottom of steam frame 131*b* includes four hook-and-loop fastener receiving elements 68 to be attached to fastener bands 117 on upper surface 118*b* of steam frame 131. Steam frame 131 includes a front wall 81, a rear wall 82, a right side wall 83 and a left side wall 84. Bottom surface 131*b* of steam frame 131 includes a plurality of vanes 86 extending from steam opening 66 and cavity 67 to the edge of frame 131 and grooves 87 in frame bottom surface 131*b* and feet 89. Vanes 86 extend about 50 to 150 mm above frame bottom surface 131*b*. Vanes 86 help disperse the steam uniformly throughout frame 131 when in use and allow for venting of steam between pad 222 and frame bottom surface 131*b*. Feet 89 also provide leveling and stability when mopping. In use steam is released from beneath pad 222 at the edge of frame 131 when pad 222 is attached to steam frame 131. Vanes 86 extend between about 5 to 15 mm above the bottom solid surface of bottom 131*b* so that open spaces 90 between pad 222 and frame 131 operate as vents to release steam before it condenses and wets the fabric layers of pad 222.

Steam appliances 11 with steam frames 31 and 131 and towel pocket or pad 22, 122 and 222 in accordance with the invention provides vast improvements for steam cleaners for cleaning carpeted surfaces. The invention avoids the friction that would be cause by using a steam pocket 122 on a fabric or carpet.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

The present invention may be embodied in other specific forms without departing from the spirit or essential attributes of the invention. Accordingly, reference should be made to the appended claims, rather than the foregoing specification, as indicating the scope of the invention.

What is claimed is:

1. A fabric towel with slider pattern for a steam appliance, comprising:

at least one substantially planar layer of fabric;

a slider pattern disposed on one surface of the fabric to reduce friction between the fabric towel and a fabric or carpet surface being steamed and provide a sufficient amount of exposed towel to provide steam, wherein the slider pattern has raised regions and thin regions to allow bending of the fabric towel, the raised regions having rounded edges to improve the slidability of the fabric towel, and the thin regions being recessed so as to not make contact with the fabric or carpet surface being steamed when the fabric towel is bent; and at least one fastener on the fabric to secure the towel to a steam frame.

2. The towel of claim 1, wherein the slider pattern is disposed at least about the perimeter of the towel.

3. The towel of claim 1, wherein the slider pattern covers between about 10 to 50 percent of the surface area of the fabric towel.

4. The towel of claim 1, wherein the slider pattern is formed from a polymeric material.

5. The towel of claim 4, wherein the polymeric material is selected from the group consisting of polyolefers, nylons, polyesters and acetals.

6. The towel of claim 1, including a top and a bottom layer of fabric joined on two short sides and one long side to provide an open side to allow for mounting on a steam cleaner frame.

7. The towel of claim 6, the fastener includes a pair of straps secured to one layer along the open side adapted to wrap around the back of the frame and be secured to the second layer of fabric.

8. The towel of claim 1, wherein at least one fastener is secured to the top layer of fabric in a position to correspond to at least one anchor fastener on the steam cleaner frame.

9. The towel of claim 6, wherein both layers of fabric includes the slider pattern.

10. The towel of claim 1, in combination with a steam frame of a steam appliance.

11. The towel and steam frame combination of claim 10 included within a steam mop appliance.

12. A steam frame comprising:

(a) a body portion; and (b) a towel with slider pattern configured to be received by the body portion, the towel having:

(i) top and bottom layers of fabric joined on two short sides and one long side to provide an open side to allow for mounting on the body portion;

(ii) a slider pattern disposed on one of the top and bottom layers of fabric to reduce friction between the towel and a surface to be steamed, the slider pattern including raised regions and thin regions to allow bending of the towel, the raised regions having rounded edges to improve slidability of the towel, and the thin regions being recessed such that the thin regions do not come into physical contact with the surface to be steamed; and (iii) at least one fastener on the towel to secure the towel to the body portion.

13. The steam frame of claim 12, wherein the body portion is rectangular or triangular.

14. The steam frame of claim 12, wherein the fastener includes a pair of straps secured to the top layer of fabric along the open side, wherein the pair of straps are adapted to wrap around the back of the body portion and be secured to the bottom layer of fabric.

15. The steam frame of claim 12, wherein the fastener is secured to one of the top and bottom layers of fabric in a position to correspond to at least one anchor fastener on the body portion.

16. A steam appliance comprising:

(a) a steam frame;

(b) a fabric towel with slider pattern configured to be received by the steam frame, the fabric towel having:

(i) two substantially planar layers of fabric;

(ii) a slider pattern disposed on one of the two substantially planar layers of fabric to reduce friction between the fabric towel and a surface being steamed, wherein the slider pattern has raised regions and thin regions to allow bending of the fabric towel, the raised regions having rounded edges to improve the slidability of the fabric towel, and the thin regions being recessed so as to avoid making physical contact with the surface being steamed; and (iii) at least one fastener on the fabric to secure the fabric towel to the steam frame, wherein the fastener includes at least one strap secured to one of the two substantially planar layers of fabric, wherein the strap is adapted to wrap around the back of the steam frame and be secured to at least one anchor fastener on one of the two substantially planar layers of fabric.

17. The steam appliance of claim 16, wherein the steam appliance is a steam mop.

* * * * *